United States Patent [19]

Imai et al.

[11] Patent Number: 4,590,139

[45] Date of Patent: May 20, 1986

[54] THREE COLOR TONER KIT AND METHOD OF USE

[75] Inventors: Eiichi Imai, Narashino; Motoo Urawa, Funabashi, both of Japan

[73] Assignee: Canon Kabushiki Kaisha, Tokyo, Japan

[21] Appl. No.: 789,348

[22] Filed: Oct. 21, 1985

Related U.S. Application Data

[63] Continuation of Ser. No. 532,518, Sep. 15, 1983, abandoned.

[30] Foreign Application Priority Data

Sep. 27, 1982 [JP] Japan ..... 57-168114
Sep. 27, 1982 [JP] Japan ..... 57-168115

[51] Int. Cl.[4] ..... G03G 13/01; G03G 9/08
[52] U.S. Cl. ..... 430/45; 430/106
[58] Field of Search ..... 430/106, 45

[56] References Cited

U.S. PATENT DOCUMENTS 2,297,691 10/1942 Carlson .
4,258,116 3/1981 Taitasu et al. ..... 430/106 X
4,518,672 5/1985 Urawa et al. ..... 430/106

FOREIGN PATENT DOCUMENTS 54-136836 10/1979 Japan ..... 430/106
57-10149 1/1982 Japan ..... 430/106
57-130043 8/1982 Japan ..... 430/106
57-130045 8/1982 Japan ..... 430/106

*Primary Examiner*—Roland E. Martin
*Attorney, Agent, or Firm*—Fitzpatrick, Cella, Harper & Scinto

[57] ABSTRACT

By combination of a resin exhibiting a melt viscosity of $10^5$ cp at a temperature of $T_1$ and a melt viscosity of $0.5\times10^5$ cp at a temperature of $T_2$, said temperatures satisfying the following relationships:

$T_1=100°-150°$ C., and $|\Delta T|=|T_1-T_2|=5°-30°$ C., and at least one of yellow, magenta and cyan colorants having specific structures, a color toner for electrostatic copying excellent in overlapping characteristic, spectral reflection characteristic, transparency, charging characteristic, durability, etc. can be obtained.

3 Claims, No Drawings

THREE COLOR TONER KIT AND METHOD OF USE

This application is a continuation of application Ser. No. 532,518 filed Sept. 15, 1985 abandoned.

BACKGROUND OF THE INVENTION

1. Field of the Invention

This invention relates to a color toner to be used for image formation in electrostatography, including electrostatic copying electrophotography, etc.

2. Description of the Prior Art

Heretofore, various methods for electrophotography have been disclosed in U.S. Pat. No. 2,297,691, Japanese Patent Publications No. 23190/1977 and No. 24748/1978. These methods generally comprise utilizing a photoconductive material, forming electrostatic images on photosensitive members of the photoconductive material by various means, then developing the latent images with a toner, followed by transfer of the toner images onto papers or other materials, as desired, and thereafter fixing the images by heating, pressurization or with the use of solvent vapor. Also, for obtaining multi-color images, the original copy is exposed to light through a color resolution filter, the above electrophotographic steps are repeated by use of color toners, respectively, of yellow, magenta and cyan, and the toner images are successively overlapped to give color images.

For such color toners, while various characteristics are required similarly as in the case of a black toner for monochromatic copying, such as excellent charging characteristic, small extent of dependency on environment, small extent of degradation on repeated continuous usage and others, they are further required to satisfy characteristics inherent in color toners as indispensable characteristics, such as good spectral reflection characteristic, good color mixing characteristic, high degree of transparency, etc.

However, due to limited available materials in order to obtain good hue, transparency, etc., other characteristics including charging characteristic and durability cannot sufficiently be satisfied. Thus, under the present situation, improvements of color toners are incessantly sought after.

SUMMARY OF THE INVENTION

The present invention has been accomplished in view of the state of the art as described above, and its primary object is to provide a color toner having good spectral reflection characteristic, color mixing characteristic and transparency, and having also excellent characteristics with respect to charging, durability, etc.

The above object can be accomplished by a color toner according to the present invention comprising a resin exhibiting a melt flow viscosity of $10^5$ cp at a temperature of $T_1$ and a melt flow viscosity of $0.5\times10^5$ cp at a temperature of $T_2$, the temperatures $T_1$ and $T_2$ satisfying the following relationships:

$$T_1=100-150^\circ\text{ C., and } |\Delta T|=|T_1-T_2|=5-30^\circ\text{ C.,}$$

and at least one colorant selected from the groups shown below:

(A) yellow colorants:

(1) colorants represented by the formula (I):

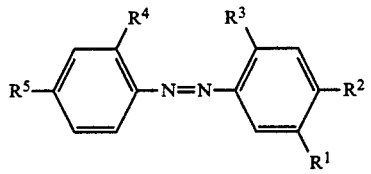

(I)

wherein $R^1$ represents lower alkyl, $R^2$ and $R^3$ each independently hydrogen or hydroxyl, $R^4$ hydrogen or hydroxyl and $R^5$ hydrogen, acyl, amino having terminal acyl;

(2) colorants to be classified under C.I. Disperse Yellow 164, (B) magenta colorants:

(3) the colorant represented by the formula (II):

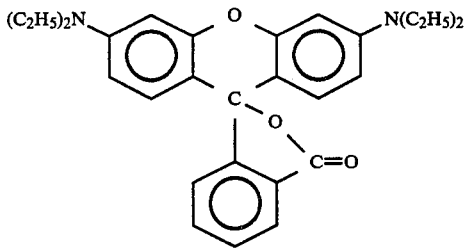

(II)

(4) colorants represented by the formula (III):

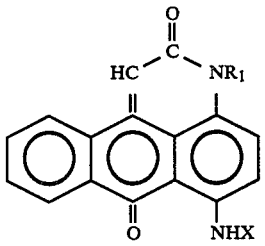

(III)

wherein X is a substituent represented by the formula:

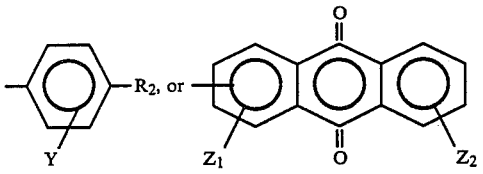

$R_1$ is hydrogen or alkyl; $R_2$ is hydrogen, alkyl, hydroxyl, phenyl or phenyl having a substituent (any of hydrogen, halogen and alkyl), sulfo group or any of salts thereof with alkali metals, alkaline earth metals, ammonium ion, aliphatic ammonium ion or heterocyclic ammonium ion; each of $Z_1$ and $Z_2$ is independently hydrogen, hydroxy or alkyl, (C) cyan colorants:

(5) colorants represented by the formula (IV):

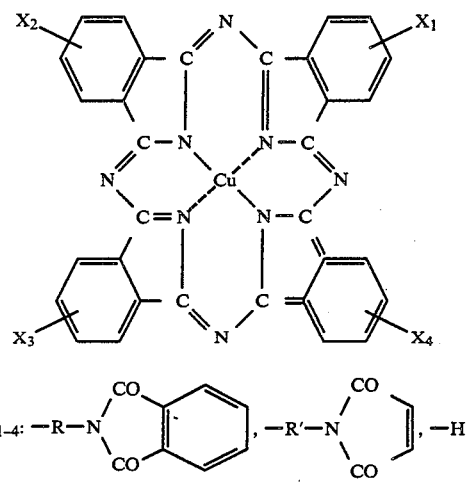

(IV)

R, R': alkylene having 1 to 5 carbon atoms, with proviso that the number of hydrogen atoms in each of $X_1$–$X_4$ is any of 0, 1, 2 and 3.

DESCRIPTION OF THE PREFERRED EMBODIMENTS

The constituents of the toner of the present invention are described below. In the following description, "parts" and "%" representing compositions are given on weight basis, unless otherwise noted.

A particularly important constituent in the toner of the present invention is a resin exhibiting a melt viscosity of $10^5$ cp at a temperature of $T_1$ and a melt viscosity of $0.5\times10^5$ cp at a temperature of $T_2$, the temperatures $T_1$ and $T_2$ satisfying the following relationships:

$$T_1=100-150°\text{ C., and } |\Delta T|=|T_1-T_2|=5-30°\text{ C.}$$

The viscosity range of from 0.5 to $1\times10^5$ cp is chosen because the viscosity at which overlapping of respective colors can be effected lies around this range. The resins having these temperature-melt viscosity characteristics are characterized by the fact that they will undergo very sharp drop in viscosity under heating. Such viscosity drop will cause appropriate mixing of the uppermost toner layer with the lowest toner layer, further with concomitant remarkable increase in transparency of the toner layer per se, thereby effecting good subtractive color mixing.

If a resin with $T_1$ lower than 100° C. is employed for a toner, the resultant toner will be subject readily to blocking, thus involving a problem in storage stability. On the other hand, in the case of a resin with $T_1$ higher than 150° C., color mixing characteristic will become worse and also difficulty is encountered in fixing characteristic.

Meanwhile, even if $T_1$ is within the range from 100° to 150° C., in the case of a toner which will undergo gradual changes in viscosity with the changes in temperature, for example, a toner with $|\Delta T|=40°$ C., although a temperature for effecting an adequate color mixing exists, drawbacks are involved such that the temperature is too high, that no reproduction of clear color is possible or that, when the temperature is relatively lower, the glass transition temperature is too low and blocking is liable to be caused. The particularly preferred range of $|\Delta T|$ is from 5° to 25° C.

Preferable binder resins for toner may include those satisfying the above viscosity-temperature characteristics selected from, for example, styrene resins (homopolymer or copolymer containing styrene or styrene derivative) as exemplified by polystyrene, polychlorostyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymers (e.g. styrene-methyl acrylate copolymer, styrene-ethyl acrylate copolymer, styrene-butyl acrylate copolymer, styrene-octyl acrylate copolymer, styrene-phenyl acrylate copolymer etc), styrene-methacrylate copolymers (e.g. styrene-methyl methacrylate copolymer, styrene-ethyl methacrylate copolymer, styrene-butyl methacrylate copolymer, styrene-phenyl methacrylate copolymer, etc.), styrene-methyl α-chloroacrylate, styrene-acrylonitrileacrylate copolymer, etc.; vinyl chloride resin; styrene-vinyl acetate copolymer; rosin-modified maleic acid resin; phenol resin; epoxy resin; polyester resin; low molecular weight polyethylene; low molecular weight polypropylene; ionomer resins; polyurethane resin; silicone resin; ketone resin; ethylene-ethyl acrylate copolymer; xylene resin, polyvinyl butyral resin; and so on.

Particularly preferable binder resins include polystyrene, styrene-acrylate copolymers, styrene-methacrylate copolymers, styrene-maleic acid copolymer, styrene-butadiene copolymer, polyester resin, and epoxy resin.

The above resins can be used either singly or as a combination of two or more kinds, as long as the above viscosity-temperature characteristics can be satisfied.

Method for preparation of these resins is not particularly limited, but any of mass polymerization, solution polymerization, emulsion polymerization and suspension polymerization may be available.

In the present invention, measurement of viscosity was conducted by means of a B-type rotary viscometer (B8H-type, mfd. by Tokyo Keiki K.K.) for high viscosity equipped with a thermostat tank (Viscon-HI, Model VC-250 mfd. by Toyo Seisakusho K.K.) capable of heating directly samples and a rotor and by using a rotor No. 4 or No. 5.

In the present invention, it is important to use a compound selected from the group of the compounds of the above formulae (I) to (IV) and the compounds to be classified under C.I. Disperse Yellow 164 in combination with the resin as described above, Preferable examples of the compounds represented by the above formula (I) are shown below:

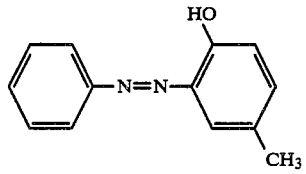

Compound I

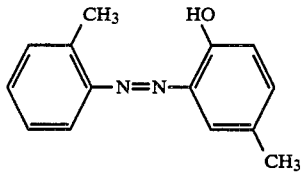

Compound II

-continued

Compound III

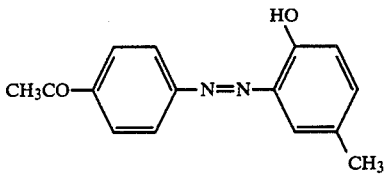

Compound IV

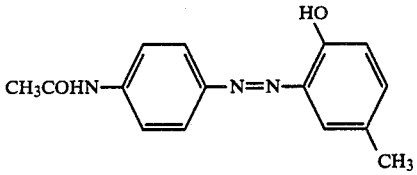

Compound V

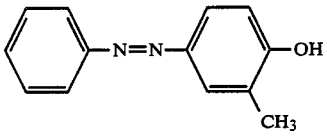

The compounds to be classified under C.I. Disperse Yellow 164 may be exemplified by Disperse Polyester Light Yellow CF, Kayaset Yellow 963, etc. Both of the above groups of compounds can be very well dispersed in a binder resin to function as a colorant giving clear yellow color, while they also fulfill the function as an effective charge controlling agent.

The compounds represented by the formula (II) are to be classified under CI Solvent Red 49, and may include, for example, commercially available products such as Aizen Rhodamine B Base, Rhodamine Base FB, etc. These are very good in hue, and can give sufficient coloring capacity even when used in a minute amount.

Specific examples of the compounds represented by the above formula (III) are enumerated below:

Compound VI

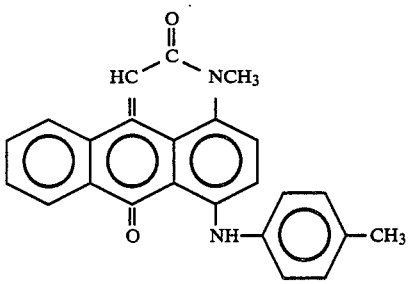

Compound VII

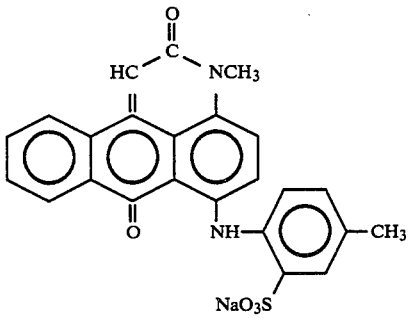

-continued

Compound VIII

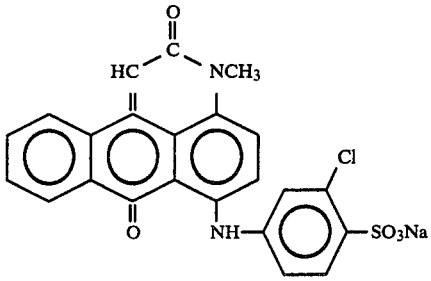

Compound IX

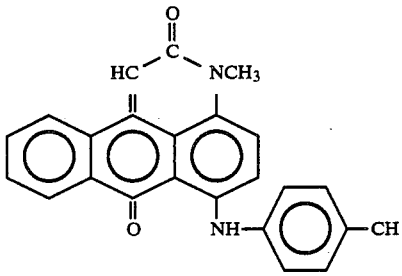

Compound X

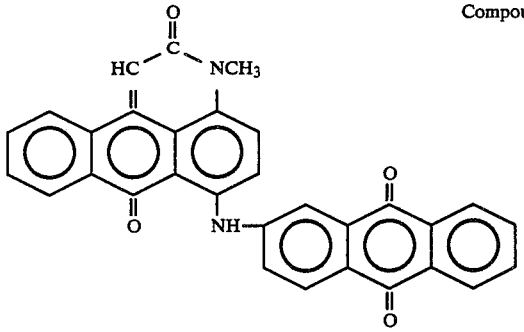

Compound XI

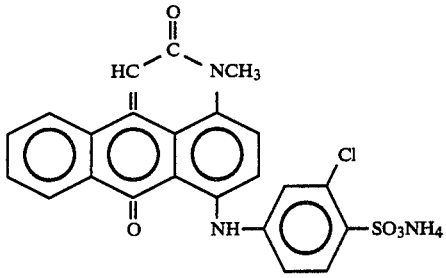

Compound XII

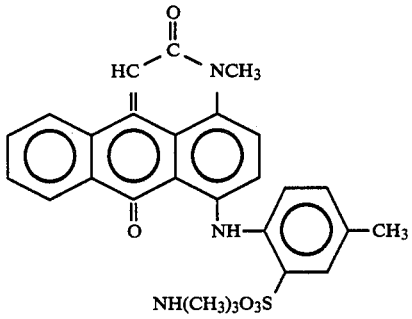

-continued

Compound XIII

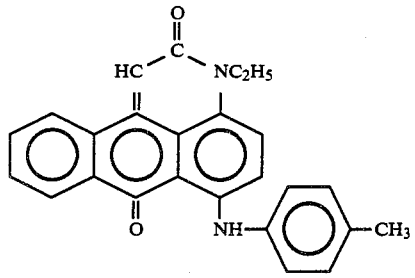

Compound XIV

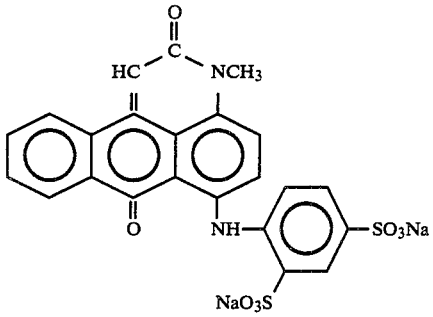

Compound XV

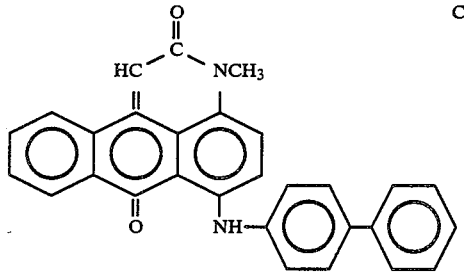

Compound XVI

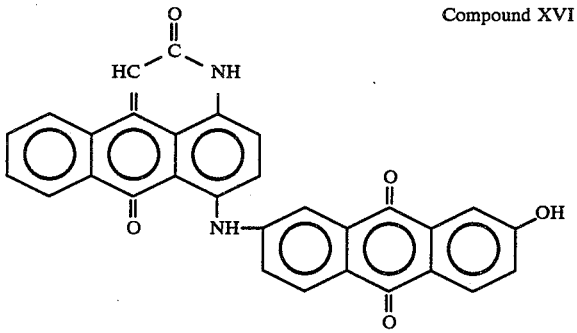

Compound XVII

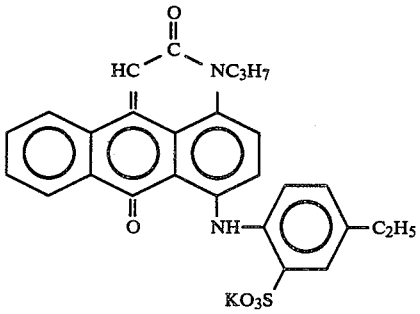

-continued

Compound XVIII

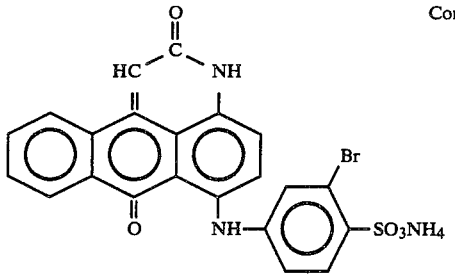

Specific examples of the cyan colorants represented by the formula (IV) are those in which all the groups $X_{1-4}$ in the formula (IV) are either one of the groups (a)–(d) set forth below:

(a)

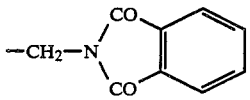

(b)

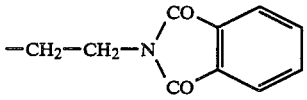

(c)

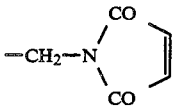

(d)

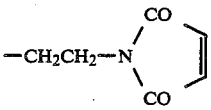

These cyan colorants may be synthesized, for example, in the case when all of the above-mentioned $X_{1-4}$ groups are the group (a), by allowing copper-phthalocyanine chloromethyl derivative synthesized from 4-chloromethylphthalocyanine nitrile to react directly with potassium phthalimide.

These compounds may be used in a combination of two or more kinds among those which can give respective colors of yellow, magenta and cyan. It is also possible to mix coloring compounds of two or more colors.

These coloring compounds may be used generally in amounts of 0.1 to 30 parts, preferably 0.3 to 10 parts, per 100 parts of the resin. More specifically, the amount may be determined suitably so as to give a preferable charging characteristic also in view of other conditions such as the charging characteristic of the binder resin, the kind of the colorant to be used in combination. Among the colorants as described above, the yellow colorants and the magenta colorants represented by the formula (III) also have functions as charge controlling agents.

These compounds, when used in combination with the specific resin as described above, have very good spectral reflection characteristic and transparency as their composite effect. For example, when combined with other yellow, magenta or cyan toners, a wide range of color reproduction can be exhibited simultaneously with reproduction of clear black color. Further, their composite effect is very effective for improvement of overall electrophotographic characteristics such as improvement to a great extent of durability life, prevention of lowering in transfer efficiency, prevention of adhesion of unnecessary toner to a photosensitive drum, improvement of cleaning characteristic, improvement in non-dependency on environment, and so on.

The toner of the present invention may also contain a charge controlling agent incorporated therein. For example, when it is to be used as a negative toner, a metal chelate of an alkylsalicylic acid may be used; or when it is used as a positive toner, dimethylaminoethyl methacrylate-styrene copolymer may be used. Further, a material for improving free flowing property such as colloidal silica may be added to the toner of the present invention in an amount of 0.01 to 5%, preferably 0.1 to 2%.

The toner of the present invention may be prepared according to the procedures of, for example, melting and kneading a blend of the above-mentioned resin and colorant compounds, optionally admixed with additives such as a charge controlling agent, crushing the resultant mixture, micropulverizing the powders, and classifying the resultant fine powders into desired colorant powders with particle sizes of, for example, 5 to 20μ.

The yellow, magenta and cyan toners thus produced may be respectively packed and may be distributed in combination in the form of a color toner kit, as desired.

The present invention is described in further detail by referring to the following Examples and Comparative examples.

EXAMPLE 1

A blend of 100 parts of a polyester resin ($T_1=126°$ C., $T_2=139°$ C., $|\Delta T|=13°$ C.), 7.5 parts of a compound classified under C.I. Disperse Yellow-164 was mixed and crushed in a ball mill and then melted and kneaded on a roll mill. After cooling, the resultant mass was coarsely pulverized by means of a hammer mill, then finely pulverized by means of a finely pulverizing machine according to the air jet system. The resultant fine powder was classified and particles with sizes of 1–20μ were chosen to provide toner. The toner (12 parts) was mixed with 88 parts of carrier iron powder to provide a developer.

The amount of triboelectric charges in the toner of this developer was measured to be −9.1 μc/g. Measurement of the triboelectric charges was conducted according to the blow off method (See Preprint (1975.5) published by Electrophotographic Society, Japan about its details). This method was also used in measurement of the triboelectric charges in subsequent Examples. When copying was performed by means of a color copying machine (NP-color copying machine mfd. by Canon K.K.) by use of this developer, yellow images could be obtained at extremely good levels with respect to spectral reflection characteristic, transparency, fog, image density, gradation, adhesiveness at solid color portion, sharpness at line portions, etc. When continuous copying was carried out on 5,000 sheets, no lowering in quality of the copied image was observed, without occurrence of adhesion of unnecessary toner on the photosensitive drum or cleaning badness.

EXAMPLE 2

A toner was produced in the same manner as in Example 1 except for changing the toner composition as follows:

| | |
|---|---|
| Styrene-acrylic resin ($T_1 = 145°$ C., $T_2 = 163°$ C., $\|\Delta T\| = 18°$ C.) | 100 parts |
| Compound IV as shown above | 6 parts |

Colloidal silica was added to this toner in an amount of 0.5 wt.% based on the toner.

When copying was performed by means of the NP-color copying machine with the use of this developer, clear yellow images were obtained similarly as in Example 1. Continuous copying of 5,000 sheets gave no deterioration phenomenon. Further, when this developer was left to stand under high temperature and high humidity conditions of 35° C. and 85%, no deterioration of various characteristics was observed. By the way, this toner was found to have an amount of triboelectric charges of −9.9 μc/g.

On the other hand, a magenta developer was produced in the same manner as above except for replacing 6 parts of Compound IV with a mixture of 2.5 parts of Rhodamine base FB and 5 parts of Compound VI, and a cyan developer with 5 parts of a cyan colorant of Formula (IV) with each of groups $X_1$–$X_4$ being group (a)

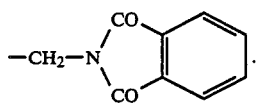

When copying was performed by use of the yellow, magenta and cyan developers thus obtained in combination, clear color images with very good color reproducibility could be obtained, and the portion corresponding to black color in the original was reproduced in pure black.

EXAMPLES 3–4

Example 1 was repeated except that the toner composition was changed as follows, whereby satisfactory results could be obtained in each case.

| Example | Composition | |
|---|---|---|
| 3 | Polyester resin ($T_1 = 110°$ C., $T_2 = 132°$ C., $\|\Delta T\| = 22°$ C.) | 100 parts |
| | Compound V as shown above | 3 parts |
| | Compound classified under C.I. Disperse Yellow 164 | 3.5 parts |
| 4 | Styrene-maleic acid resin ($T_1 = 133°$ C., $T_2 = 158°$ C., $\|\Delta T\| = 25°$ C.) | 100 parts |
| | Compound II as shown above | 4 parts |
| | Compound classified under C.I. Disperse Yellow 164 | 2 parts |

EXAMPLE 5

| | |
|---|---|
| Polyester resin ($T_1 = 138°$ C., $\|\Delta T\| = 20°$ C.) | 100 parts |
| Rhodamine base FB | 2.5 parts |
| Compound VI | 5 parts |
| 3,5-di-t-butylsalicylic acid chromium complex | 2 parts |

The above composition was mixed and crushed in a ball mill and then kneaded by melting on a roll mill. After cooling, the mass was coarsely pulverized by means of a hammer mill, then finely pulverized by means of a finely pulverizing machine according to the air jet system. The resultant fine powder was classified and particles with sizes of 1–20μ were chosen, and 1 wt.% of a colloidal silica was added thereto to provide toner. The toner (10 parts) was mixed with 90 parts of carrier (reduced iron powder produced by Dowa Teppun K.K.) to provide a developer. When copying was performed by means of the NP-color copying machine (produced by Canon K.K.) by use of this developer, the copied product was found to be extremely good in spectral reflection characteristic and exhibit clear magenta colors, without occurrence of cleaning badness.

On the other hand, a yellow developer was produced in the same manner as above except for replacing the above mixture colorant with 7.5 parts of the yellow colorant (C.I. Disperse Yellow-164) used in Example 1, and a cyan developer with 5 parts of the cyan colorant used in Example 2.

When copying was performed by use of the thus obtained magenta, yellow and cyan developers in combination, clear color images with very good color reproducibility could be obtained, and the portion corresponding to black color in the original manuscript was reproduced in pure black.

EXAMPLE 6

| | |
|---|---|
| Styrene-acrylic resin ($T_1$ = 145° C., $\|\Delta T\|$ = 15° C.) | 100 parts |
| Rhodamine base FB | 0.5 parts |
| Compound VII | 1 part |
| 3,5-di-t-butylsalicylic acid chromium complex | 2 parts |

Example 5 was repeated except that the toner composition was changed as shown above. As the result, the copied image obtained after continuous copying of 5,000 sheets by using the magenta toner thus prepared was found to exhibit very clear magenta color without fog, and no cleaning badness, etc. was generated at all.

On the other hand, a yellow developer was produced in the same manner as above except for replacing the above mixture colorant with 6 parts of the yellow colorant (Compound IV), and a cyan developer with 5 parts of the cyan colorant used in Example 2.

When copying was performed by use of the resultant magenta, yellow and cyan developers in combination, clear color images with very good color reproducibility could be obtained, and the portion corresponding to black color in the original manuscript was reproduced in pure black.

EXAMPLE 7

| | |
|---|---|
| Styrene-butadiene resin ($T_1$ = 135° C., $\|\Delta T\|$ = 25° C.) | 100 parts |
| Rhodamine base FB | 5 parts |
| Compound VIII | 10 parts |
| 3,5-di-t-butylsalicylic acid chromium complex | 2 parts |

Example 5 was repeated except that the toner composition was changed as shown above. As the result, the copied image after continuous copying of 5,000 sheets was found to exhibit very clear magenta color without fog, and no cleaning badness, etc. was generated at all.

On the other hand, a yellow developer was produced in the same manner as above except for replacing the above mixture colorant with 6 parts of the yellow colorant (Compound IV), and a cyan developer with 5 parts of the cyan colorant used in Example 2.

When copying was performed by use of the thus obtained magenta, yellow and cyan toners in combination, clear color images with very good color reproducibility could be obtained, and the portion corresponding to black color in the original manuscript was reproduced in pure black.

EXAMPLE 8

| | |
|---|---|
| Polystyrene resin ($T_1$ = 120° C., $\|\Delta T\|$ = 9° C.) | 90 parts |
| Rhodamine base FB | 1 part |
| Compound XIV | 2 parts |
| Dimethylaminoethyl methacrylatestyrene copolymer | 10 parts |

When a developer was prepared similarly as in Example 5 by use of the above toner composition and negative latent images on a zinc oxide photosensitive paper was developed by use thereof, very clear magenta positive images were obtained.

COMPARATIVE EXAMPLE 1

| | |
|---|---|
| Polyester resin ($T_1$ = 138° C., $\|\Delta T\|$ = 20° C.) | 100 parts |
| Rhodamine base FB | 0.05 part |
| Compound VI | 0.10 part |
| 3,5-di-t-butylsalicylic acid chromium complex | 2 parts |

Example 5 was repeated except that the toner composition was changed as shown above. As the result, the copied image was thin as a whole to give only unclear image.

COMPARATIVE EXAMPLE 2

| | |
|---|---|
| Styrene-acrylic resin ($T_1$ = 145° C., $\|\Delta T\|$ = 15° C.,) | 100 parts |
| Rhodamine base FB | 7.5 parts |
| Exemplary compound X | 15 parts |
| 3,5-di-t-butylsalicylic acid chromium complex | 2 parts |

Example 5 was repeated except that the toner composition was changed as shown above. As the result, the copied image gave rise to a fogging phenomenon with increased background density to give only unclear image. Further, this fogging phenomenon became more marked after continuous copying of 5,000 sheets.

COMPARATIVE EXAMPLE 3

A magenta toner and a magenta developer were prepared according to the same procedure as in Example 5 except for using a styrene-butadiene resin having $T_1$=148° C. and $|\Delta T|$=48° C. as the binder resin.

On the other hand, a yellow developer was produced in the same manner as above except for replacing the above mixture colorant with 6 parts of the yellow colorant (Compound IV), and a cyan developer with 5 parts of the cyan colorant used in Example 2.

When copying was performed by use of thus obtained magenta, yellow and cyan developers in combination, only an unclear image was obtained, which was insufficient in color mixing.

As described above, by a novel combination of a colorant and a resin according to the present invention, yellow magenta cyan toners were obtained which were very excellent in spectral reflection characteristic. In addition, by using these toners in combination, an intense black color was produced through overlapping of the three colors, whereby a color toner kit for electrophotography capable of maintaining the image quality at a high level against repeated uses and changes in environment could be obtained.

What is claimed is:

1. A method for forming multi-color images by electrostatography, comprising:

developing eloctrostatic latent images with a yellow toner, a magenta toner, and a cyan toner;

transferring the resultant color toner images to a recording medium, and fixing the transferred toner images on the recording medium, thereby to obtain multi-color images; wherein said yellow, magenta and cyan toners respectively comprising 100 parts by weight of a resin exhibiting a melt flow viscosity of $10^5$ cp at a temperature of $T_1$ and a melt flow viscosity of $0.5\times10^5$ cp at a temperature of $T_2$, said temperatures $T_1$ and $T_2$ satisfying the following relationships:

$$T_1=100^\circ \text{ to } 150^\circ \text{ C. and } \Delta T=|T_1-T_2|=5$$

to 30° C., and 0.3 to 10 parts by weight of a corresponding color of colorants selected from the group consisting of yellow colorants, magenta colorants, and cyan colorants (A) said yellow colorants being:

(1) colorants represented by the formula (I):

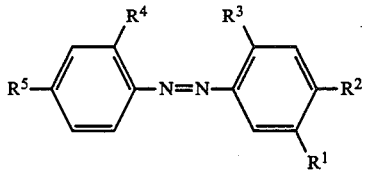

(I)

Wherein $R^1$ is a lower alkyl, $R^2$ and $R^3$ are each independently hydrogen or hydroxyl, $R^4$ is hydrogen or hydroxyl and $R^5$ is hydrogen, acyl, or amino having a terminal acyl; and (2) colorants to be classified under C.I. Disperse Yellow 164, (B) said magenta colorants being:

(3) the colorant represented by the formula (II):

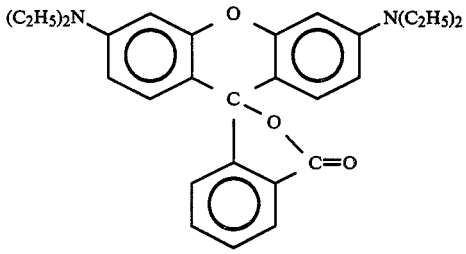

(II)

and (4) colorants represented by the formula (III):

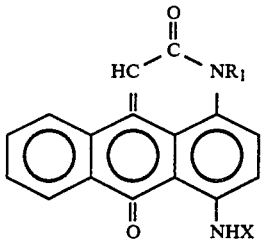

(III)

wherein X is a substituent represented by the formula:

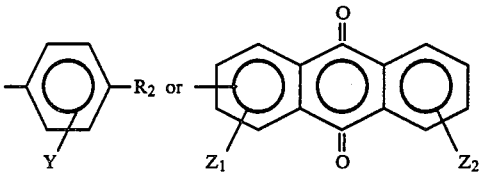

$R_1$ is hydrogen, alkyl, hydroxyl, phenyl or phenyl having a hydrogen, halogen or alkyl substituent, sulfo or any of salts thereof with alkali metals, alkaline earth metals, ammonium ion, aliphatic ammonium ion or heterocyclic ammonium ion; $Z_1$ and $Z_2$ are each independently hydrogen, hydroxy or alkyl, (C) said cyan colorants being:

(5) colorants represented by formula (IV):

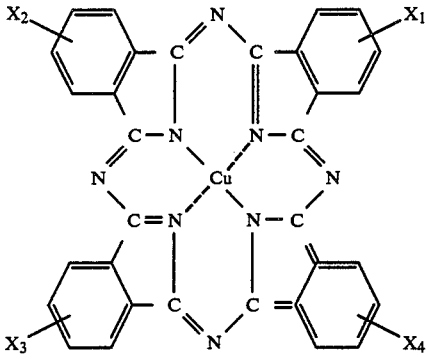

(IV)

wherein $X_1$,$X_2$,$X_3$ and $X_4$ are each independently:

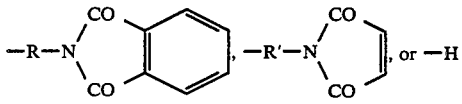

wherein R and R' are an alkylene having 1 to 5 carbon atoms, with the proviso that the number of hydrogen atoms in each of $X_1$–$X_4$ is any of 0, 1, 2 and 3.

2. The method of claim 1 including employing said resin selected from polystyrene, styrene-acrylate copolymers, styrene-methacrylate copolymers, sytrene-maleic acid copolymer, styrene-butadiene copolymer, polyester resin, and epoxy resin.

3. A color toner kit comprising, in combination, a yellow toner package containing a yellow toner, a magenta toner package containing a magenta toner and a cyan toner package containing a cyan toner; said yellow toner, magenta toner and cyan toner respectively comprising 100 parts by weight of a resin exhibiting a melt viscosity of $0.5\times10^5$ cp at a temperature of $T_2$, said temperatures $T_1$ and $T_2$ satisfying the following relationships:

$$T_1=100-150°\text{ C., and } |\Delta T|=|T_1-T_2|=5°\text{-}30°\text{ C.},$$

and 0.3 to 10 parts by weight of at least one colorant selected from the group consisting of (A) yellow colorants, (B) magenta colorants and (C) cyan colorants, (A) said yellow colorants being:

(1) colorants represented by the formula (I):

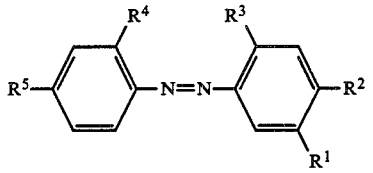

(I)

wherein $R^1$ is a lower alkyl, $R^2$ and $R^3$ are each independently hydrogen or hydroxyl, $R^4$ is hydrogen or hydroxyl and $R^5$ is hydrogen, acyl or an amino having a terminal acyl; and (2) colorants to be classified under C.I. Disperse Yellow 164, (B) said magenta colorants being:

(3) the colorant represented by the formula (II):

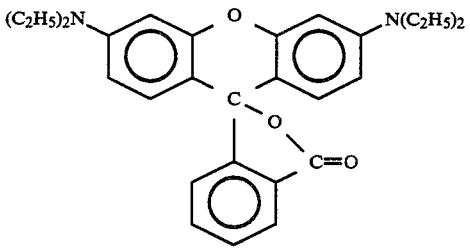

(II)

and (4) colorants represented by the formula (III):

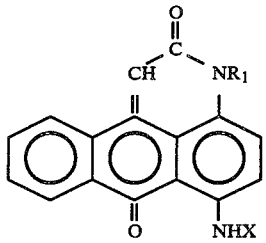

(III)

Wherein X is a substituent represented by the formula:

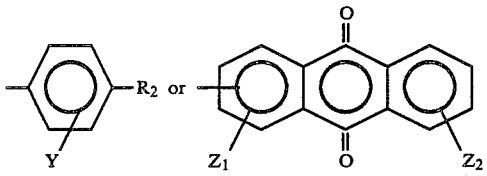

$R_1$ is hydrogen or alkyl; $R_2$ is hydrogen, alkyl, hydroxyl, phenyl or phenyl having a substituent (any of hydrogen, halogen and alkyl), sulfo or any of salts thereof with alkali metals, alkaline earth metals, ammonium ion, aliphatic ammonium ion or heterocyclic ammonium ion; $Z_1$ and $Z_2$ are each independently hydrogen, hydroxy or alkyl, (C) said cyan colorants being:

(5) colorants represented by the formula (IV):

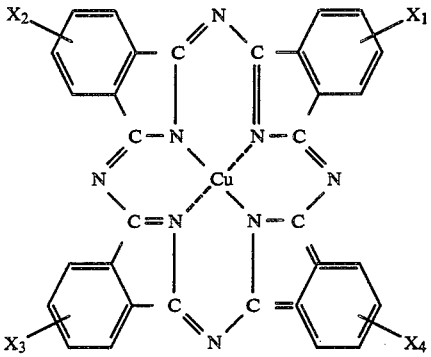

(IV)

wherein $X_1$, $X_2$, $X_3$ and $X_4$ are each independently

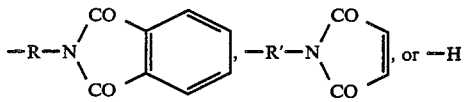

wherein R and R' are an alkylene having 1 to 5 carbon atoms, with the proviso that the number of hydrogen atoms in each of $X_1$–$X_4$ is any of 0, 1, 2 and 3.

* * * * *

UNITED STATES PATENT AND TRADEMARK OFFICE

CERTIFICATE OF CORRECTION

PATENT NO. : 4,590,139

DATED : May 20, 1986

INVENTOR(S) : EIICHI IMAI, ET AL.

It is certified that error appears in the above-identified patent and that said Letters Patent is hereby corrected as shown below:

COLUMN 1

Line 6, "filed Sept. 15, 1985" should read --filed Sept. 15, 1983--.

COLUMN 13

Line 29-31, "=5 to 30°C.," should read --=5 to 30°C.,--.

COLUMN 14

Line 23, "hydrogen, alkyl," should read --hydrogen or alkyl; $R_2$ is hydrogen, alkyl,--.

Signed and Sealed this

Thirty-first Day of March, 1987

*Attest:*

DONALD J. QUIGG

*Attesting Officer*

*Commissioner of Patents and Trademarks*